United States Patent [19]

Humphries

[11] Patent Number: 4,457,426

[45] Date of Patent: Jul. 3, 1984

[54] MULTIPLE BOTTLE ASSEMBLY

[75] Inventor: Romilly H. Humphries, Dover, Mass.

[73] Assignee: S.A.Y. Industries, Inc., Leominster, Mass.

[21] Appl. No.: 493,584

[22] Filed: May 11, 1983

Related U.S. Application Data

[63] Continuation-in-part of Ser. No. 310,095, Oct. 9, 1981, abandoned.

[51] Int. Cl.[3] ..... B65D 85/62; B65D 71/00; B65D 75/00

[52] U.S. Cl. ..... 206/158; D9/391; 206/148; 206/153; 206/427; 294/87.2

[58] Field of Search ..... 206/158, 148, 153, 427; 294/87.2, 87.28; D9/391, 351, 355

[56] References Cited

U.S. PATENT DOCUMENTS

| | | | |
|---|---|---|---|
| D. 74,185 | 1/1928 | Miller et al. | D9/391 |
| 2,710,219 | 7/1955 | Zalkind | 294/87.28 |
| 4,139,094 | 2/1979 | Berry et al. | 206/148 |
| 4,218,086 | 8/1980 | Klygis | 206/153 |

*Primary Examiner*—William T. Dixson, Jr.

[57] ABSTRACT

A combination of a plurality of bottles and a carrier therefor. The bottles are each formed with elongated necks having an annular flange forming a barb-like member intermediate the ends of the bottle neck. A carrier for a plurality of bottles, preferably six, is made of an integrally formed plastic sheet shaped to conform with the upper portion of the body of the bottle below the annular flange. The carriers are also formed with openings having four symmetrically arranged tabs projecting inwardly to engage the lower surface of the bottle flange.

11 Claims, 6 Drawing Figures

MULTIPLE BOTTLE ASSEMBLY

This application is a continuation-in-part of application Ser. No. 310,095 filed Oct. 9, 1981 now abandoned.

SUBJECT MATTER OF THE INVENTION

The present invention relates to a carrier for a plurality of bottles.

BACKGROUND OF INVENTION

In recent years, multiple bottle carriers have evolved from cardboard or paper board carriers to plastic carriers. Cardboard carriers, which are being replaced by plastic carriers, consist of complex folded pieces of cardboard that required significant folding and securing means to shape them into an appropriate means for supporting bottles from the bottom. The more recently developed plastic molded carriers are conventionally formed of a single piece of vacuum molded plastic with a plurality of openings in which the necks of the bottles are commonly secured. Exemplifications of the presently available unitary plastic molded carriers include those used commercially for soft drinks. Such carriers are made by Owens Illinois, under the trademarks CONTOUR-PAK/PLASTI-SHIELD, as well as others. These plastic carriers have significant advantages over previously-used "paper board wrap-around carriers". Exemplifications of the conventional wrap-around carriers are illustrated in U.S. Pat. No. 4,180,191.

The plastic carriers presently used, however, have certain limitations. The conventional plastic carrier has not been optimally design to carry bottles having long necks. Such bottles are commonly used for wine, oil additives for automobile engines, anti-freeze, and the like. Consequently, there is a need for a plastic carrier optimally designed for bottles having elongated necks.

Existing prior art designed for supporting bottles with elongated necks are not altogether satisfactory. Thus, for example, U.S. Pat. No. 4,109,787 illustrates a carrier for a bottle with an elongated neck. That design, however, does not provide a carrier in which the bottle is secured against accidental dislodgement.

SUMMARY OF INVENTION

In the present invention, there is provided an improved carrier and bottle combination in which the carrier is especially designed to securely engage a plurality of bottles having elongated necks. A further object of the present invention is to provide an improved carrier for a plurality of bottles in which the carrier may be inexpensively vacuum molded of a single piece of plastic material without subsequent manufacturing steps and which may be compactly stacked for shipping. A further object of the present invention is to provide a carrier for a plurality of bottles in which the bottles may be removed one at a time from the carrier by positive force without destroying the carrier and without affecting the ability of the carrier to support and secure the remaining bottles. A further object of the present invention is to provide a carrier in which means are provided for relatively easy insertion of a bottle into the carrier.

In the present invention, there is provided in combination a carrier and a plurality of bottles. The bottles are each formed with an elongated tapered neck with an annular flange integrally formed in the neck between the ends of the neck. The flanges of each bottle are formed with an upper surface and a lower surface. The upper surface is closer to the bottle opening and the lower surface is closer to the bottom of the bottle. The upper surface is formed with a width greater than the width of the lower surface. The combination of the larger upper surface and shorter lower surface shapes the flange into a barb-like configuration in cross section. The entire bottle is preferrably integrally molded of a thermoplastic material. The carrier for commonly carrying the bottles is formed of a one-piece integrally molded plastic sheet having a plurality of openings, with each opening designed to receive the neck of a bottle. The openings each have a plurality of tabs projecting inwardly with each tab having an inner edge shaped to the curvature of the bottle neck. These inner edges engage the bottle neck immediately below or at the lower surface of the flange.

BRIEF DESCRIPTION OF DRAWINGS

The foregoing objects and advantages of the present invention will be more clearly understood when considered in conjunction with the accompanying drawings in which.

DETAILED DESCRIPTION OF DRAWINGS

Figure 1:
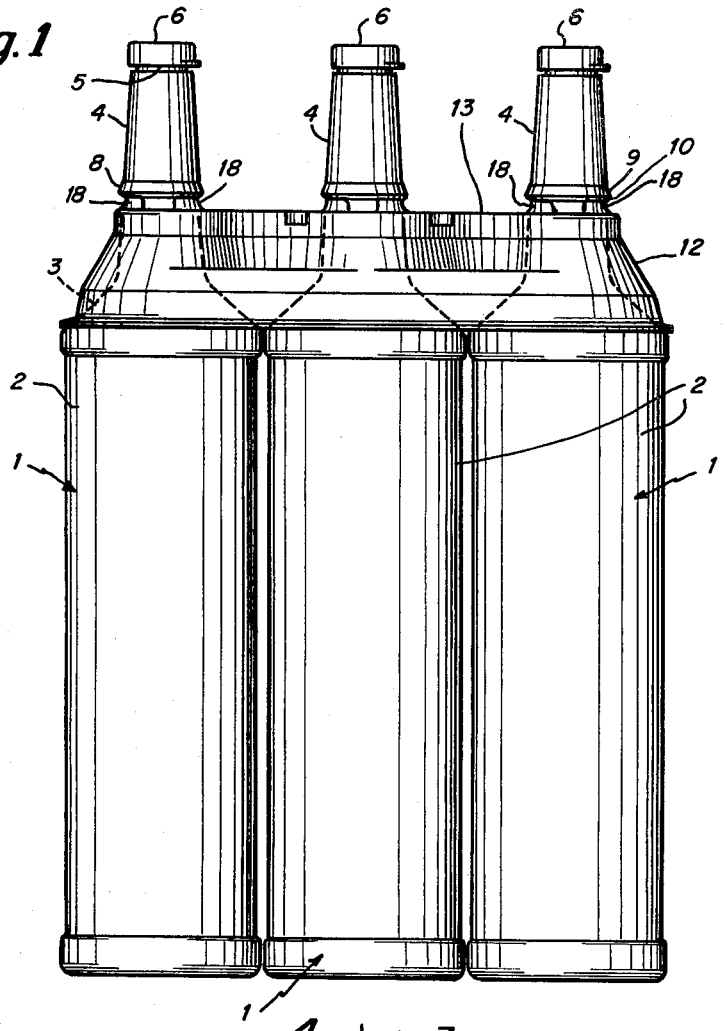
FIG. 1 is an elevational view of a preferred embodiment of this invention.
Figure 2:
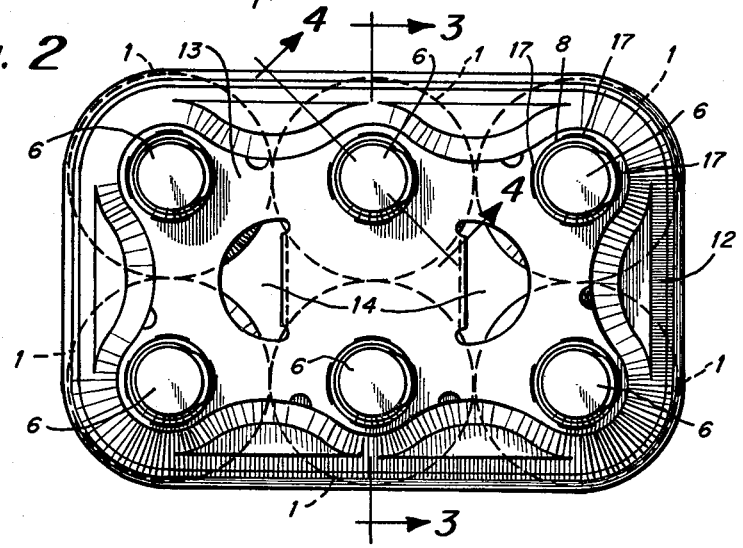
FIG. 2 is a top plan view of the embodiment illustrated in FIG. 1.

As illustrated in the drawings, a plurality of bottles 1 are formed with a body 2 preferably tapered in a conic section 3 to an elongated tapered neck 4. The open end 5 of the bottle may be suitably closed by a cap or cover 6 in any acceptable fashion. The elongated neck 4 may vary in length, depending upon the specific application for the bottle. This invention, however, contemplates the use of bottles with elongated necks of at least 2 inches in length and with a diameter at the wider end of the neck of at least 1 inch in diameter. The taper of the elongated neck may also vary, but in general, the taper is usually only in the order of 5° to 10°.

Intermediate the open end 5 and the base 7 of the neck is an annular flange 8. The annular flange 8 is integrally formed with the bottle neck and includes an annular upper surface 9 and an annular lower surface 10. The upper surface 9 has a width which is preferably at least twice as wide as the lower surface 10. This arrangement of surfaces form the annular flange into a barb-like configuration in cross section as illustrated in FIGS. 3 and 4.

The means 3 for commonly carrying the plurality of bottles is preferably formed of a conventionally molded plastic sheet. Preferably this means 3 is vacuum formed in the shape illustrated in the drawings. In this arrangement, the means 3 may be formed with a depending sidewall 12 generally shaped to cover the lower portion of the necks of the bottle and the conic sections 3. The specific sidewall 12 configuration may vary, depending upon the particular bottles to be carried and need not be shaped specifically to the bottle outlined. The upper edges of the depending side walls 12 are integrally formed with and connected by cover 13. The cover 13 is formed with a pair of holes 14, suitably shaped and spaced to function as finger carriers. The holes 14 are conventionally at least 2 inches long and 1 to 3 inches apart.

Figure 5:
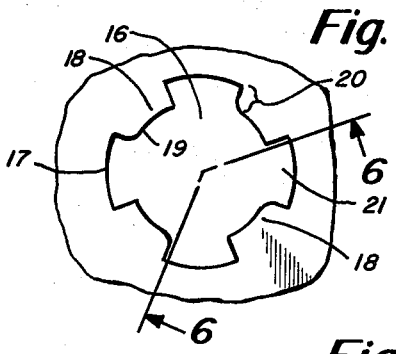
FIG. 5 is a fragmentary top plan view of the carrier about an opening.
Figure 6:
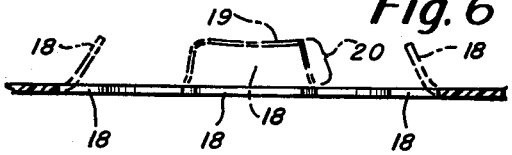
FIG. 6 is a cross-sectional view along line 6—6 of FIG. 5.

The cover 13 is additionally formed with six openings 16, best illustrated in FIGS. 5 and 6. These openings 16 are each shaped to receive the neck 4 of a bottle. The openings 16 are preferably formed with a circumference 17 shaped and sized to fit in close proximity to the neck of the bottle immediately below the annular flange 8 as illustrated in FIG. 3. Symmetrically arranged about the periphery 17 of the opening 16 are a plurality of tabs 18. Each of these tabs projects inwardly from the periphery 17 of the opening 16. The inner edges 19 of the tabs 18 are arcuately shaped to conform with the contour of the bottle neck 4. The length 20 of the tabs 18 between periphery 17 and edge 18 may vary, but preferably should be approximately one-third to one-quarter of the radius of the opening 16.

Figure 3:
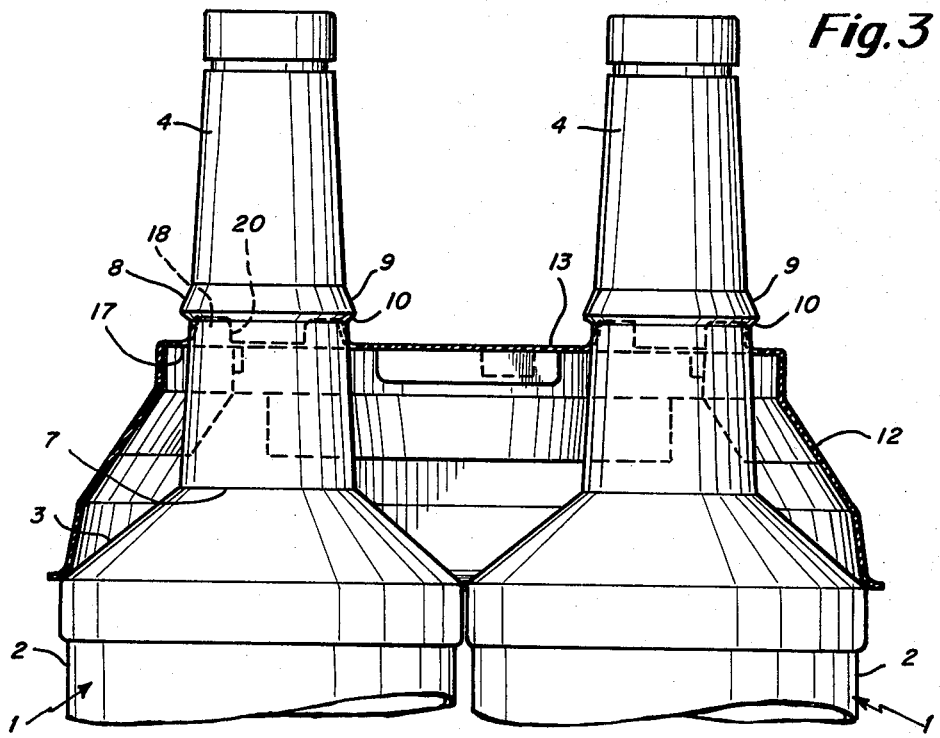
FIG. 3 is a fragmentary cross-sectional view taken along the line 3—3 of FIG. 2.
Figure 4:
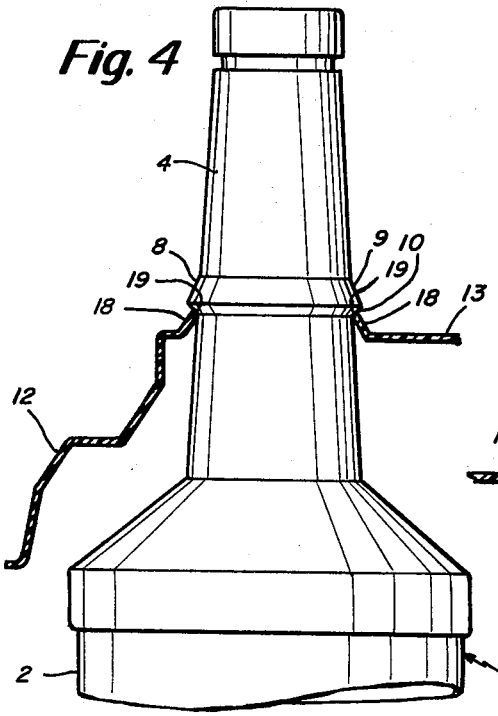
FIG. 4 is a cross-section elevation taken along the line 4—4 of FIG. 2.

As illustrated in FIG.3, the circumference 17 of the opening 16 should engage the sidewall of the bottle 4 at a distance from the lower surface 10 substantially equal to the length 20 of the tabs 18. The tabs 18 may vary in width but preferably four tabs as illustrated in FIG. 5 should have a total width of approximately one-half of the circumference of the opening 16. Thus, as illustrated in FIG. 5, the spaces 21 between the tabs 18 are approximately equal in length to the lengths of the tabs themselves.

As illustrated in FIG. 3, each bottle 1 projects through an opening 16 with a tab 18 engaging the bottle neck immediately below the lower surface 10 of the ring and with the circumference 17 of the cover 13 resting adjacent to the surface of the bottle. Because of the barb-like configuration of the flange 8, these bottles may be readily inserted through each of the openings 16. When the bottles are inserted through these openings, the wider surface 9 of the flange deflects the tabs 18 over the flange until the flanges have passed under the surface 10 to engage the neck 4 of the bottle at this flange 8.

The tabs 18 are preformed to project upwardly from the cover 13, as illustrated in FIG. 6. Since the tabs are formed of a conventional vacuum formed plastic, the tabs will flex at the circumference 17 to permit the tabs to pass over the flanges 8. However, the engagement of the tabs 18 with the bottom surface of the flange 8 tends to resist movement of the bottle from the carrier once the flange 8 has been engaged.

The bottle 1 is preferrably integrally molded of a thermoplastic material. The upper portion of the bottle 1, including the conic section 3, the elongated tapered neck 4, and the annular flange 8 are rigid and inflexible, thus permitting effective engagement with or disengagement from the tabs 18 of the carrier means 3. The body 2 forming the lower portion of the bottle 1 is flexible to permit easier dispensing of fluid contained therein. The body 2 of the bottle may be of any of a variety of sizes and need not be of the long, slender design shown in FIG. 1.

Having now described my invention, I claim:

1. A molded bottle of thermoplastic material having an elongated tapered neck with an annular flange integrally formed in said neck intermediate the ends thereof, said flange having an upper surface closer to the bottle opening, said upper surface being positioned non-perpendicularly with respect to longitudinal axis of said bottle and a lower surface closer to the bottom of said bottle, said lower surface being positioned non-perpendicularly with respect to the longitudinal axis of said bottle, said upper surface being at least twice the width of said lower surface, said upper and lower surfaces being positioned at an angle with respect to each other and forming a barb-like configuration in cross-section, said bottle having an upper portion adjacent said neck, said upper portion being tapered in a conic section, said elongated tapered neck being tapered at an angle.

2. A bottle as set forth in claim 1, wherein said neck is at least 2 inches in length.

3. A bottle as set forth in claim 1, wherein said neck is tapered at an angle of no more than 5°–10°.

4. A bottle as set forth in claim 3, wherein said neck has a width at its wider end of at least one inch in diameter.

5. In combination a plurality of bottles and means for commonly carrying said bottles comprising:

a plurality of bottles, with each bottle being molded of thermoplastic material and having an elongated tapered neck with an annular flange integrally formed in said neck intermediate the ends thereof, said flange having an upper surface closer to the bottle opening, said upper surface being positioned non-perpendicularly with respect to longitudinal axis of said bottle and a lower surface closer to the bottom of said bottle, said lower surface being positioned non-perependicularly with respect to the longitudinal axis of said bottle, said upper surface being at least twice the width of said lower surface, said upper and lower surfaces being positioned at an angle with respect to each other and and forming a barb-like configuration in cross-section, said bottle having an upper portion adjacent said neck, said upper portion being tapered in a conic section, said elongated tapered neck being tapered at an angle;

a means for commonly carring said bottles comprising a one-piece integrally molded plastic sheet having means forming a plurality of openings each of which is shaped to receiving a neck of one of said bottles; and means projecting from the edge of each of said openings for engaging said flange and securing said neck in said opening.

6. A combination as set forth in claim 5 wherein each of said openings is shaped to conform with and be positioned parallel to the neck of the bottle immediately below said flange, said means projecting from the edge of said opening comprising a tab integrally formed with said common carrying means and having an inner edge shaped to conform with and engage the neck of the bottle at said lower surface.

7. A combination as set forth in claim 6 wherein said opening is circular and said neck is circular in cross section, and said inner edge of said tab is arcuate.

8. A combination as set forth in claim 7 wherein each opening is formed with four tabs arranged uniformly around the inner periphery of said opening.

9. A combination set forth in claim 5, wherein said neck of said bottle is at least 2 inches in length.

10. A combination as set forth in claim 5, wherein said neck of said bottle is tapered at an angle of no more than 5°–10°.

11. A combination as set forth in claim 10, wherein said neck of said bottle has a width at its wider end of at least one inch in diameter.

* * * * *